United States Patent [19]

Marks

[11] Patent Number: 4,712,582

[45] Date of Patent: Dec. 15, 1987

[54] REVERSING VALVE ASSEMBLY WITH IMPROVED PILOT VALVE MOUNTING STRUCTURE

[75] Inventor: Robert T. Marks, Columbus, Ohio

[73] Assignee: Ranco Incorporated, Dublin, Ohio

[21] Appl. No.: 15,507

[22] Filed: Feb. 9, 1987

Related U.S. Application Data

[63] Continuation of Ser. No. 652,833, Sep. 20, 1984, abandoned.

[51] Int. Cl.[4] ..... F16K 31/42; F16K 11/00

[52] U.S. Cl. ..... 137/625.29; 137/625.43; 335/278; 251/129.15

[58] Field of Search ..... 137/625.43, 625.64, 137/625.6, 625.29; 251/129, 30.01, 30.02, 30.03, 30.04, 30.05, 129.15; 91/451; 335/278, 255; 62/324.6

[56] References Cited

U.S. PATENT DOCUMENTS

| | | | |
|---|---|---|---|
| 1,333,681 | 3/1920 | Riley | 251/129 X |
| 2,695,154 | 11/1954 | Dillman | 251/77 |
| 2,976,701 | 3/1961 | Greenawalt | 251/129 X |
| 3,274,525 | 9/1966 | Valleau | 335/255 |
| 3,369,790 | 2/1968 | McHale et al. | 137/625.43 X |
| 3,460,798 | 8/1969 | Carsten | 251/30.05 |
| 3,502,109 | 3/1970 | Straight | 137/625.64 |
| 3,965,923 | 6/1976 | Allen | 251/129 X |
| 4,027,700 | 6/1977 | Perkins | 137/625.43 X |
| 4,202,373 | 5/1980 | Hargraves et al. | 137/625.43 X |
| 4,270,726 | 6/1981 | Hertfelder et al. | 251/30.03 |
| 4,409,580 | 11/1983 | Ishigaki | 335/278 |

OTHER PUBLICATIONS

Ranco Inc., "Bulletin 1919-1".

*Primary Examiner*—Arnold Rosenthal

*Attorney, Agent, or Firm*—Watts, Hoffmann, Fisher & Heinke

[57] ABSTRACT

A refrigerant reversing valve assembly comprising a refrigerant reversing valve including a fluid pressure actuable reversing valving member for reversing the direction of refrigerant flow in a refrigeration system, a pilot valve unit for controlling actuation of the valving member comprising a pilot valve housing in fluid communication with the reversing valving member, an actuable pilot valving member in the housing, and pilot valve actuating means comprising a pilot valving actuating member plunger coupled to the pilot valving member, a guide tube surrounding the plunger connected to the pilot valve body and projecting therefrom, and a solenoid surrounding the guide tube for actuating the plunger, and supporting structure for interconnecting the reversing valve and the pilot valve unit. The supporting structure includes an anchoring panel rigidly fixed with respect to the reversing valve and rigidly fixed to the pilot valve unit for securing the reversing valve and pilot valve unit together with the plunger guide tube projecting away from the anchoring panel in a first direction, a rigid retainer panel detachably connected to the guide tube projecting end remote from the anchoring panel for maintaining said solenoid in position with respect to said guide tube between the panels, and coupling panels engaged between the anchoring and retainer panels.

11 Claims, 4 Drawing Figures

REVERSING VALVE ASSEMBLY WITH IMPROVED PILOT VALVE MOUNTING STRUCTURE

DESCRIPTION

This is a continuation of copending application Ser. No 652,833 filed on Sept. 20 1984 now abandoned.

1. Technical Field

The present invention relates to refrigerant reversing valve assemblies and more particularly to refrigerant reversing valve assemblies including integral solenoid operated pilot valves for controlling operation of the refrigerant reversing valves.

2. Background Art

Refrigerant flow reversing valves are widely used in refrigeration systems, such as heat pump units, where the flow direction of refrigerant through system heat exchangers is periodically reversed. The refrigerant flow reversing valves have commonly been operated by fluid pressure to reverse the refrigerant flow direction. Typically a fluid pressure controlling pilot valve unit was attached to the refrigerant reversing valve to form a refrigerant reversing valve assembly which was installed as a unit in the refrigeration system.

The pilot valve units included a pilot valve for supplying actuating fluid pressure to the reversing valve and an electric pilot valve actuator. The pilot valves have generally been multi-way, two position valves formed by a pilot valve housing containing a pilot valving member. The pilot valves supplied actuating refrigerant pressure to desired reversing valve housing locations depending on the pilot valve position.

Pilot valve actuators commonly included a solenoid having a plunger-like armature for shifting the pilot valving member and a solenoid coil for moving the plunger or armature. The plunger was mechanically connected to the pilot valving member and projected from the pilot valve housing within a sealed plunger guide tube. The guide tube was hermetically joined to the pilot valve housing and projected away from the valve housing for receiving and supporting the solenoid coil. In most constructions the guide tube had a hermetically closed projecting end region in which a plunger biasing spring was supported.

Pilot valve solenoids were usually constructed from a cylindrical wound coil encapsulated by dielectric plastic material to form a generally cylindrical body having a central cylindrical plunger guide tube receiving bore. The solenoid bore was sized to provide a snug yet slip fitting clearance with the guide tube. The solenoid body was tightly embraced by a generally rectangular metal framework covering both ends of the coil body and extending along diametrically opposed body sides. The framework served primarily to establish a flux path about the solenoid while incidentally providing some physical protection for the coil body. The framework was permanently assembled to the coil body and provided, in some cases, a structure for connection to the plunger guide tube.

The pilot valve housing was rigidly connected to the reversing valve by a bracket. The plunger guide tube projected away from the pilot valve housing and the mounting bracket to receive and support the solenoid coil body. The guide tube constructions carried a threaded stud at one end which projected through a conforming opening in the framework so that by threading a nut onto the guide tube stud the coil body and framework could be secured in place on the guide tube.

Although the prior art refrigerant reversing valve assemblies provided for effective, reliable reversing valve operation there were some drawbacks attendant the designs. Because the plunger guide tube supported the coil body and framework, the guide tube necessarily projected from the pilot valve housing and from the support bracket in cantilever fashion. Accordingly, the guide tube was subject to damage from impacts and more gradually applied bending loads. During the manufacturing process, as a result of handling, and during shipment, the guide tubes were occassionally subjected to forces sufficient to crimp or collapse the guide tubes enough to prevent movement of the pilot valve plunger.

The same disadvantage obtained after the reversing valve assembly was installed in a heat pump unit with the solenoid in place. If the solenoid or its framework was struck with a tool or was otherwise subjected to a load of some sort, the guide tube could experience excessive bending stress and crimped or collapsed thus wedging the plunger in place so that the pilot valve could not be operated. The kind of damage referred to was, for all intents and purposes, fatal to the reversing valve assembly and was more likely to occur after assembly of the solenoid to the pilot valve than prior to the assembly.

Secondly, the construction of the solenoid framework and its assembly to the solenoid body required a substantial number of manufacturing operations, yet did not provide for highly efficient magnetic coupling between the coil and the armature plunger. Furthermore the framework limited the orientation of the solenoid with respect to the reversing valve when the assembly was completed. That is to say, the solenoid coil was encapsulated with the lead wires projecting from the solenoid in a particular direction. Once a solenoid was assembled in its framework that solenoid could only be placed on a guide tube in a single orientation with respect to the reversing valve assembly. Depending on the particular installation, the coil leads could sometimes interfere with adjacent parts and equipment.

Disclosure of Invention

The present invention provides a new and improved refrigerant reversing valve assembly wherein the pilot valve unit is connected to the reversing valve housing by a supporting structure which provides a substantially simplified structurally strong interconnection while protecting the pilot valve plunger tube from damage and positively supporting the pilot valve solenoid.

In a preferred embodiment of the invention the new supporting structure is provided by an anchoring panel fixed to the pilot valve unit and to the reversing valve with the pilot valve plunger guide tube projecting away from the anchoring panel. A retainer panel is detachably connected to the projecting guide tube end region remote from the anchoring panel for enabling assembly of the solenoid to the guide tube and maintaining the solenoid in place between the panels. Coupling panels rigidly extending between the anchoring and retainer panels protect the guide tube from impacts and bending loads and complete the supporting structure.

The respective anchoring and retainer panels each includes a fixed solenoid supporting hub surrounding the guide tube and extending into the solenoid. The solenoid is thus suspended between the panel hubs rather than being supported by the guide tube itself.

The panel hubs and their associated panels form pole pieces for the solenoid, and, with the coupling panels, serve to direct and conduct flux in a highly efficient manner about the solenoid. The hubs so significantly improve the magnetic coupling between the support structure panels and the solenoid that relatively smaller, lower current solenoids have been found to operate the pilot valve as effectively as the larger, higher current solenoids employed with the prior art pilot valves.

In a reversing valve assembly employing a pilot valve unit mounting structure constructed according to the invention the anchoring panel and the coupling panels are formed from a continuous sheet metal body with one coupling panel welded to the reversing valve housing, the anchoring panel extending transversely away from the coupling panel and the second coupling panel extending from the anchoring panel generally parallel to the first coupling panel so that the armature guide tube extends between and is protected by the coupling panels. The retainer panel is secured to the guide tube in firm engagement with the coupling panels to assure a rigid enclosure for the solenoid and an efficient solenoid flux conducting path.

Other features and advantages of the invention will become apparent from the following detailed description of a preferred embodiment of the invention made with reference to the accompanying drawings which form part of the specification.

BEST MODE FOR CARRYING OUT THE INVENTION

Figure 1:
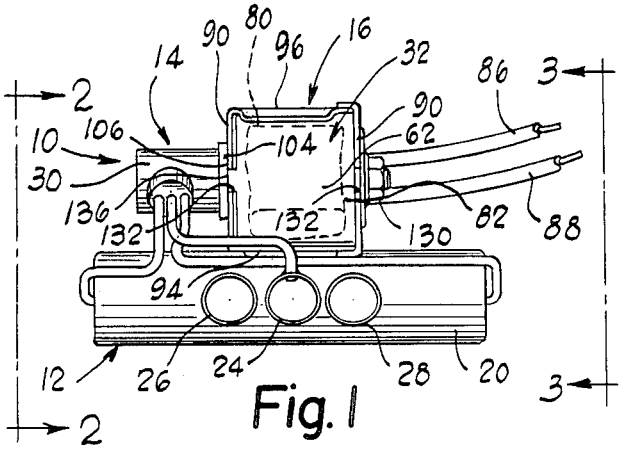
FIG. 1 is an elevational view of a reversing valve assembly constructed according to the invention.

A refrigerant reversing valve assembly 10 constructed according to the present invention is illustrated by FIG. 1 of the drawings and includes a refrigerant reversing valve, generally indicated by the reference character 12, a pilot valve unit 14 for governing operation of the refrigerant reversing valve 12, and supporting structure 16 for interconnecting the reversing valve 12 and the pilot valve unit 14. The reversing valve assembly 10 is of the sort which is installed in a refrigeration system, such as a heat pump unit, for reversing the direction of refrigerant flow through system heat exchangers and thereby changing the refrigeration system mode of operation from one which functions to cool indoor air to one in which the indoor air is heated. Heat pump units are widely known and therefore drawings and further description of the refrigerant system with which the assembly 10 is associated are omitted for brevity.

The refrigerant reversing valve 12 comprises a tubular generally cylindrical valve housing 20, hermetically closed at both ends, which communicates with the refrigeration system by way of a compressor discharge tube 22 (FIGS. 2 and 3), a compressor intake tube 24 and refrigerant flow tubes 26, 28. The valve housing 20 contains a two position reversing valving member (not illustrated) shiftable betwen alternative positions within the valve housing to effect reversal of the system refrigerant flow in the manner referred to above. The reversing valve 12 can be of any suitable or conventional construction and therefore is not described or illustrated in detail. The preferred and illustrated valve is constructed like the valve disclosed by copending U.S. Pat. application Ser. No. 643,475 filed Aug. 23, 1984.

In one valving member position the refrigerant flowing from the compressor discharge into the valve housing 20 via the tube 22 exits the housing via the flow tube 26 while refrigerant returning to the valve housing 20 from the system flows through the tube 28 and back to the compressor intake via the outlet tube 24. When the valving member is in its alternative position, the compressor discharge refrigerant flows to the valve housing 20 via the tube 22 and exits to the system via the tube 28 while the refrigerant returning from the system to the valve housing 20 flows through the tube 26 and returns to the compressor intake via the tube 24.

The refrigerant reversing valve 12 is operated between its alternative refrigerant flow directing conditions by the pilot valve unit 14. The reversing valving member is moved in the valve housing 20 in response to applied differential actuating pressures supplied to the housing 20 by the pilot valve unit 14. The illustrated pilot valve unit 14 comprises a pilot valve 30 and a pilot valve actuator 32. The pilot valve 30 is preferably a two position four way valve arranged for controlling the actuating pressure supplied to the valve housing 20 for controlling the operational mode of the refrigeration system via the refrigerant reversing valve 12. The actuator 32 in turn controls the pilot valve position.

Figure 4:
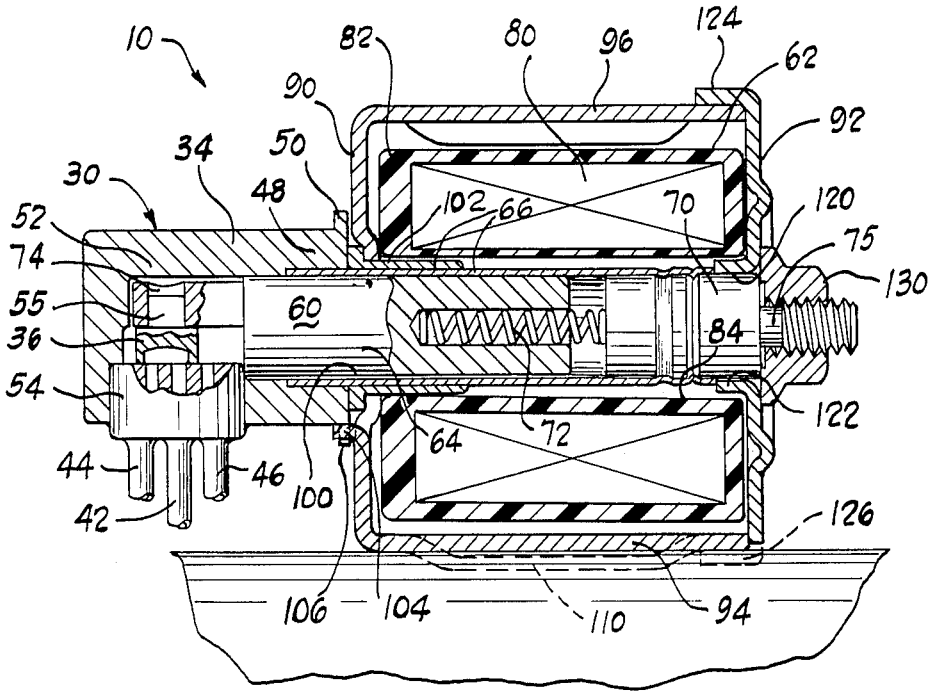

Referring to FIG. 4 the pilot valve 30 comprises a valve housing 34 containing a pilot valving member 36 which is movable between alternative positions within the housing 34. The valve housing 34 communicates with refrigerant at the compressor discharge pressure via a capillary tube 40 (see FIG. 2) hermetically joined to the housing 34 and to the inlet tube 22. The valve housing 34 communicates with the compressor suction pressure via a suction pressure capillary tube 42 hermetically joined between the housing 34 and the outlet tube 24. Discharge and suction pressure levels are distributed to the reversing valve housing 20 via capillary tubes 44, 46 extending between the pilot valve housing 34 and respective opposite ends of the reversing valve housing.

The housing 34 is preferably a tubular cylindrical member defining an internal chamber having an open end region 48 surrounded by an annular mounting flange 50 and an opposite closed end region 52. An integral pilot valve seat 54 is disposed adjacent the closed end region and defines ports within the valve housing 34 communicating respectively with the capillary tubes 42, 44, 46. The tube 40 communicates with the pilot valve housing chamber at a location spaced from the valve seat 54 so that the valve housing chamber is constantly maintained at the compressor discharge pressure.

The pilot valving member 36 is preferably formed by a cylindrical button-like element defining a valving cavity dimensioned to extend over and communicate the intake tube 42 with either the capillary tube 44 or the capillary tube 46 depending upon the pilot valving member position. A cylindrical lug 55 projects from the valving member in a direction away from the seat 54.

The pilot valve actuator 32 moves the pilot valving member between its alternative positions and in the preferred embodiment comprises a valving member actuating plunger assembly 60 mechanically attached to the valving member and a solenoid 62 for operating the plunger assembly. The pilot valving member is in one position when the solenoid is energized and in the alternative position when the solenoid 62 is de-energized.

The plunger assembly 60 includes a plunger 64 formed by solenoid armature element, a guide tube 66 for the plunger 64, a guide tube cap 70 for closing the end of the guide tube opposite the pilot valve housing and locating the plunger 64 axially relative to the guide tube, and a biasing spring 72 reacting between the guide tube cap and the plunger for biasing the pilot valving member to one position when the solenoid 62 is de-energized.

The plunger 64 is formed by a generally cylindrical member constructed from ferrous material and slidably disposed in the tube 66. The plunger is mechanically linked to the pilot valving member via a valving member supporting cross bore 74 which receives the valving member lug 55.

The guide tube 66 is a straight cylindrical thin walled tube having one end extending into the open end of the pilot valve housing where the guide tube end is hermetically attached to the pilot valve housing. The guide tube extends cantilever fashion from the valve housing with its opposite end hermetically closed by the tube cap 70.

The tube cap 70 is a generally cylindrical pluglike member conforming to the inside of the guide tube 66. An integral screw threaded stud 75 projects away from the tube cap 70 beyond the guide tube end. The cap 70 is preferably welded and crimped in place in the tube 66 to provide a structurally strong hermetic joint between the cap and the tube.

The biasing spring 72 is preferably a helical coil compression spring which reacts between the tube cap 70 and the plunger 64. In the illustrated pilot valve unit, the plunger 64 is provided with a spring receiving cavity extending along the plunger axis for maintaining the biasing spring in alignment with the plunger and the tube cap.

The solenoid 62 is formed by a helically wound wire coil 80 encapsulated within a plastic or similar dielectric moldable material to form a generally cylindrical body 82 having a central bore-like through opening 84 for receiving the guide tube 66. The opposite ends of the coil wire are connected to a pilot valve energizing circuit (not illustrated) by coil leads 86, 88, respectively, extending from the coil through the body 82.

The pilot valve unit support structure 16 is constructed and arranged to structurally interconnect the pilot valve unit 14 and the reversing valve 12 while supporting the solenoid and protecting the plunger guide tube 66 against damage both during production of the reversing valve assembly and after its installation. In the illustrated embodiment the support structure 16 includes an anchoring panel 90 projecting from the reversing valve housing 20 for rigidly securing the pilot valve unit in position with respect to the reversing valve, a detachable retainer panel 92 spaced from the anchoring panel 90 for maintaining the solenoid 62 properly assembled to the pilot valve unit and coupling panels 94, 96 extending between the anchoring and retainer panels.

The anchoring panel 90 is formed by a generally rectangular sheet metal body defining a generally circular centralized opening 100 surrounding the open end of the pilot valve body with the guide tube 66 projecting through the opening. A generally cylindrical flanged hub 102 is press fit into the opening 100 and extends generally from the plane of the anchoring panel 90 snugly about the guide tube 66. The preferred hub 102 forms a cylindrical internal opening which is slidable over and disposed in close proximity to the guide tube surface.

Axially extending tongues 104 are formed at spaced locations around the opening 100 and extend axially into respective mounting notches 106 formed at corresponding circumferential locations in the pilot valve unit housing mounting flange 50. The tongues 104 are expanded into engagement with the edges of the mounting notches 106 by staking so that the anchoring panel and power valve housing are rigidly secured together.

In the preferred and illustrated embodiment of the invention the coupling panels 94, 96 are formed contiuously with the anchoring panel 90 from a common sheet metal stamping. The coupling panels extend at right angles from opposite sides of the anchoring panel 90 along the length of the guide tube and parallel to it. Each coupling panel has a generally rectangular shape.

The coupling panel 94 extends along the reversing valve housing and is formed with two embossed longitudinal ribs 110 which engage the reversing valve housing along circumferentially spaced longitudinally extending areas. The ribs 110 are preferrably fixed to the reversing valve housing by spot welds (not shown) which serve to assure a rigid high strength connection between the structure 16 and the reversing valve.

The illustrated coupling panel 96 is generally planar except for a pair of stiffening skirts along its opposite sides which are formed by panel sections bent toward the panel 94. The coupling panels 94, 96 extend parallel to each other on opposite sides of the plunger guide tube with the coupling panels being spaced sufficiently apart to enable the solenoid 62 to be easily assembled onto the guide tube between them.

The retainer panel 92 is a generally rectangular sheet metal member detachably secured to the guide tube cap stud 75. The retainer panel forms a generally centralized guide tube opening 120 with a solenoid supporting hub 122 projecting from the opening 120 along the guide tube cap towards the anchoring panel 90. The illustrated hub 122 is formed continuously with the material of the retainer panel and has a cylindrical inner surface which is sized to slide easily over the guide tube opening and within the central, through opening of the solenoid 62. The panel side adjacent the coupling panel 96 is formed with a mounting flange 124 which extends a short distance along the coupling panel 96 when the retainer panel is attached to the guide tube. The opposite retainer panel end is provided with mounting tongues 126 which extend a short distance along the coupling panel 94. The retainer panel is secured in place to the guide tube 66 and coupling panels by a retainer nut 130 which is threaded onto the guide tube cap stud and urges the retainer panel into engagement with the coupling panels 94, 96.

During manufacture of the reversing valve assembly 10 prior to assembly of the solenoid 62 and retainer panel 92, the anchoring panel 90 and coupling panels 94, 96 serve to protect the guide tube 66 from damage which might otherwise occur during handling. Should the partially assembled reversing valve assembly be dropped or otherwise struck, the coupling panels projecting on opposite sides of the guide tube 66 effectively prevent the guide tube from sustaining impact loads which might otherwise crimp or buckle the guide tube.

When the solenoid 62 has been assembled to the valve assembly and the retainer panel 92 is secured in place the solenoid is supported on and extends between the anchoring and retainer panel hubs. The structure 16 is quite rigid and thus the support of the solenoid 62 is borne solely by the structure 16 and not by the guide tube extending through it. Thus if the solenoid is subjected to impacts or other loads which might otherwise result in bending the guide tube, the loads are worn by the structure 16 to effectively isolate the guide tube from all bending moments.

The components of the structure 16 are formed by magnetically permeable materials so that the hubs 102, 122 and their associated anchoring and retainer panels, respectively, form pole pieces for the solenoid while the coupling panels provide a highly conductive and flux path around the solenoid between the poles. The magnetic coupling between the hubs and the solenoid is highly efficient and it has been found that, utilizing the structure 16 for mounting a pilot valve unit to a reversing valve, smaller, less costly solenoids can be employed compared to those required by the prior art constructions referred to.

The new connecting structure 16 further provides for mounting the solenoid 62 in any of several different orientations with respect to the reversing valve. As illustrated by the drawings, the panels 90, 92 are each provided with notches 132, 134 respectively, on each of their sides. The solenoid body 82 is provided with a single molded in mounting tab 136 which, depending upon the orientation of the solenoid with respect to the structure 16, extends through one of the mounting notches 134, 136 in one of the anchoring or retainer panels.

Figure 2:
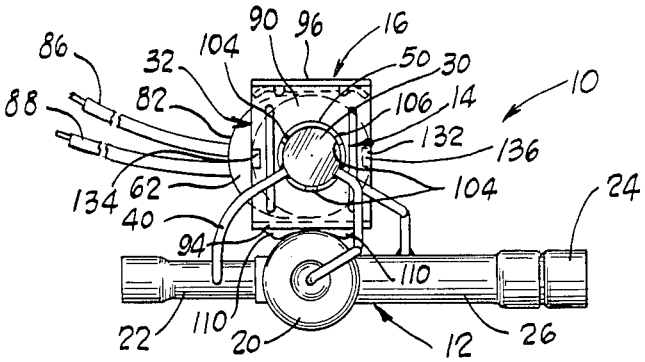
FIG. 2 is a view seen approximately from the place indicated by the line 2—2 of FIG. 1.
Figure 3:
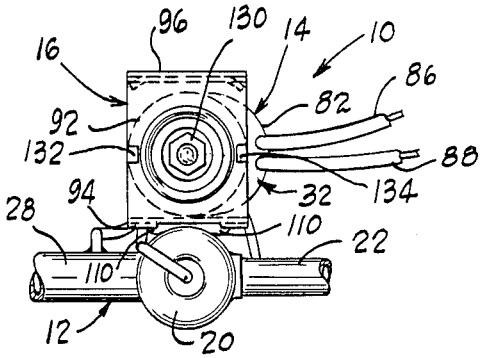
FIG. 3 is a view seen approximately from the plane indicated by the line 3—3 of FIG. 1 with parts broken away; and, FIG. 4 is a view similar to FIG. 1 with parts illustrated in cross section and parts removed.

As illustrated by the drawings the coil leads 86, 88 are molded into the solenoid body and extend from the body at an angle with respect to the solenoid body axis. The structure 16 allows the solenoid body to be placed on the guide tube with the leads extending from either side of the structure 16 between the coupling panels 64, 66 as may be desired for the particular installation in which the reversing valve assembly is to be used. For example, the valve assembly 10 of FIGS. 1–3 is illustrated with the solenoid body tab 136 engaged in the anchoring panel notch 132. In this orientation the leads 86, 88 project away from the assembly beyond the adjacent end of the valve housing 20 in the direction of the discharge flow tube 22. By reassembling the solenoid body to the guide tube with the solenoid body rotated 180° about the guide tube, the leads extend in the direction of the flow tubes 24, 26, 28 with the tab 136 engaged in the anchoring panel notch 134. By turning the solenoid body end for end, the coil leads can be oriented to extend out of either side of the structure 16 in generally opposite directions with the tab 136 engaged in either the notch 132 or the notch 134 of the retainer panel. The relationship between the tab 136 and the notches 132, 134 provides for assembly of the solenoid body in a manner fixed against rotation with respect to the structure 16.

While a single embodiment of a preferred form of the invention has been illustrated and described herein, in considerable detail the present invention is not to be considered limited to the precise construction shown. Various adaptations, modifications and uses of the invention may occur to those skilled in the art to which the invention relates and the intention is to cover hereby all such adaptations, modifications and uses which fall within the spirit or scope of the appended claims.

I claim:

1. A refrigerant reversing valve assembly comprising:

(a) a fluid pressure actuatable reversing valve for reversing the direction of refrigerant flow in a refrigeration system;

(b) a pilot valve unit for controlling actuation of said reversing valve comprising a pilot valve housing in fluid communication with said reversing valve, a pilot valving member in said housing, and pilot valve actuating means comprising a pilot valving member actuating plunger coupled to the pilot valving member, a guide tube surrounding said plunger connected to said pilot valve body and projecting therefrom, and a solenoid surrounding said guide tube for actuating said plunger; and (c) supporting means for interconnecting said reversing valve and said pilot valve unit, said supporting means comprising:

(i) anchoring panel means fixed with respect to said reversing valve and attached to said pilot valve unit for securing said reversing valve and said pilot valve unit together with said plunger guide tube projecting away from said anchoring panel means, said anchoring panel means engageable with said solenoid and including a projecting hub extending into said solenoid for supporting said solenoid in position about said guide tube; and (ii) retainer panel means detachably connected to the guide tube projecting end region remote from said anchoring panel means, said retainer panel means detachable to enable placement of said solenoid about said guide tube and connected to said guide tube for maintaining said solenoid in position with respect to said guide tube and engaged between said anchoring and retaining panel means, said retainer panel means including a projecting hub extending into said solenoid for supporting said solenoid in position about said guide tube.

2. The reversing valve claimed in claim 1 wherein said anchoring and retainer panel means and said hubs are formed from magnetically permeable materials to form solenoid pole pieces and further including coupling panel means defining magnetic flux paths between the pole pieces.

3. A refrigerant reversing valve assembly comprising:

(a) a fluid pressure actuatable reversing valve for reversing the direction of refrigerant flow in a refrigeration system;

(b) a pilot valve unit for controlling actuation of said reversing valve comprising a pilot valve housing in fluid communication with said reversing valve, a pilot valving member in said housing, and pilot valve actuating means comprising a pilot valving member actuating plunger coupled to the pilot valving member, a guide tube surrounding said plunger connected to said pilot valve body and projecting therefrom, and a solenoid surrounding said guide tube for actuating said plunger; and (c) supporting means for interconnecting said reversing valve and said pilot valve unit, said supporting means comprising:

(i) anchoring panel means fixed with respect to said reversing valve and attached to said pilot valve unit for securing said reversing valve and said pilot valve unit together with said plunger guide tube projecting away from said anchoring panel means, said anchoring panel means engageable with said solenoid;

(ii) retainer panel means detachably connected to the guide tube projecting end region remote from said anchoring panel means, said retainer panel means detachable to enable placement of said solenoid about said guide tube and connected to said guide tube for maintaining said solenoid in position with respect to said guide tube and engaged between said anchoring and retaining panel means; and (iii) coupling panel means engaged between said anchoring panel means and said retainer panel means, said coupling panel means comprising first and second coupling panels formed continuously with said anchoring panel means and extending generally parallel to each other from said anchoring panel means along said guide tube.

4. The reversing valve claimed in claim 3 wherein said reversing valve further includes a reversing valve housing and one of said first and second coupling panels extends along and is fixed to said housing.

5. A refrigerant reversing valve assembly comprising:

(a) a fluid pressure actuatable reversing valve for reversing the direction of refrigerant flow in a refrigeration system;

(b) a pilot valve unit for controlling actuation of said reversing valve comprising a pilot valve housing in fluid communication with said reversing valve, a pilot valving member in said housing, and pilot valve actuating means comprising a pilot valving member actuating plunger coupled to the pilot valving member, a guide tube surrounding said plunger connected to said pilot valve body and projecting therefrom, and a solenoid surrounding said guide tube for actuating said plunger; and (c) supporting means for interconnecting said reversing valve and said pilot valve unit, said supporting means comprising:

(i) anchoring panel means fixed with respect to said reersing valve and attached to said pilot valve unit for securing said reversing valve and said pilot valve unit together with said plunger guide tube projecting away from said anchoring panel means, said anchoring panel means engageable with said solenoid;

(ii) retainer panel means detachably connected to the guide tube projecting end region remote from said anchoring means detachable to enable placement of said solenoid about said guide tube and connected to said guide tube for maintaining said solenoid in position with respect to said guide tube and engaged between said anchoring and retaining panel means; and (iii) coupling panel means engaged between said anchoring panel means and said retainer panel means, said coupling panel means comprising at least one coupling panel formed continuously with said anchoring panel means, said coupling panel extending along and connected to said reversing valve for fixing said anchoring panel means with respect to said reversing valve.

6. The reversing valve assembly claimed in claim 5 wherein said reversing valve further comprises a reversing valve housing and said coupling panel is connected to said reversing valve housing by a weld joint.

7. A refregerant reversing valve assembly comprising:

(a) a fluid pressure actuatable refrigerant reversing valve for reversing the direction of refrigerant flow in a refrigeration system;

(b) a pilot valve unit for controlling actuation of said reversing valve comprising a pilot valving member, and pilot valve actuating means comprising a pilot valving member actuating plunger coupled to the pilot valving member, a guide tube surrounding said plunger and projecting from said pilot valve unit, and a solenoid surrounding said guide tube for actuating said plunger; and (c) supporting means for interconnecting said reversing valve and said pilot valve unit, said supporting means comprising:

(i) an anchoring panel attached to said pilot valve unit with said plunger guide tube projecting away from said anchoring panel;

(ii) means for attaching said anchoring panel to said reversing valve so that said anchoring panel secures said reversing valve and pilot valve unit together;

(iii) a retainer panel detachably connected to the guide tube remote from said anchoring panel, said retainer panel maintaining said solenoid in position with respect to said guide tube between said panels; and (iv) said retainer panel and said anchoring panel each including a hub element extending within said solenoid, said solenoid supported between said panels upon said hub elements.

8. The valve assembly claimed in claim 7 wherein said supporting means comprises coupling panel members extending between said anchoring and retainer panels, said coupling panels extending generally parallel to each other and to said guide tube.

9. The valve assembly claimed in claim 8 wherein said anchoring and retainer panels, together with the respective hub elements form pole pieces for said solenoid and said coupling panel members engage and conduct flux between said anchoring and retainer panels.

10. A refrigerant reversing valve assembly comprising:

(a) a fluid pressure actuatable refregerant reversing valve for reversing the direction of refrigerant flow in a refregeration system;

(b) a pilot valve unit for controlling actuation of said reversing valve comprising a pilot valving member, and pilot valve actuating means comprising a pilot valving member actuating plunger coupled to the pilot valving member, a guide tube surrounding said plunger and projecting from said pilot valve unit, and a solenoid surrounding said guide tube for actuating said plunger; and (c) supporting means for interconnecting said reversing valve and said pilot valve unit, said supporting means oomprising:

(i) an anchoring panel attached to said pilot valve unit with said plunger guide tube projecting away from said anchoring panel;

(ii) means for attaching said anchoring panel to said reversing valve so that said anohoring panel secures said reversing valve and pilot valve unit together;

(iii) a retainer panel detachably connected to the guide tube remote from said anchoring paneI, said retainer panel maintaining said solenoid in position with respeot to aaid guide tube between said panels; and (iv) at least one coupling panel extending between said retainer panel and said anchoring panel, said coupling panel formed integrally with one of said anchoring and retainer panels and engaging the other of said anchoring and retainer panels to support said retainer panel independently from said guide tube and minimize transmission of bending forces from said retainer panel to said guide tube.

11. The refrigerant reversing valve assembly claimed in claim 10 further including a second coupling panell extending between said retainer and anchoring panels, said second coupling panel engaging and supporting siad retainer panel against transmission of bending forces from said retainer panel to said guide tube.

* * * * *